US011767728B2

(12) United States Patent
Dharne et al.

(10) Patent No.: US 11,767,728 B2
(45) Date of Patent: Sep. 26, 2023

(54) CEMENTING PLUG FORMED WITH HIGH PRESSURE SEAL

(71) Applicant: Halliburton Energy Services, Inc., Houston, TX (US)

(72) Inventors: Avinash Gopal Dharne, Houston, TX (US); Lonnie Carl Helms, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 14 days.

(21) Appl. No.: 16/512,138

(22) Filed: Jul. 15, 2019

(65) Prior Publication Data

US 2021/0017831 A1 Jan. 21, 2021

(51) Int. Cl.

| | |
|---|---|
| ***E21B 33/12*** | (2006.01) |
| ***E21B 33/16*** | (2006.01) |
| ***E21B 37/02*** | (2006.01) |

(52) U.S. Cl.

CPC ..... *E21B 33/12* (2013.01); *E21B 33/1208* (2013.01); *E21B 33/16* (2013.01); *E21B 37/02* (2013.01)

(58) Field of Classification Search

CPC ..... E21B 33/16; E21B 33/1208; E21B 33/12; E21B 33/165; E21B 33/167

See application file for complete search history.

(56) References Cited

U.S. PATENT DOCUMENTS

| | | | | |
|---|---|---|---|---|
| 1,994,072 | A * | 3/1935 | Hardcastle | E21B 33/16 166/155 |
| 5,390,736 | A | 2/1995 | Budde | |
| 5,813,457 | A | 9/1998 | Giroux et al. | |
| 6,196,311 | B1 | 3/2001 | Treece | |
| 6,561,270 | B1 * | 5/2003 | Budde | E21B 33/16 166/153 |
| 2016/0145995 | A1 | 5/2016 | Hannegan et al. | |
| 2018/0313186 | A1 | 11/2018 | Zhang et al. | |

OTHER PUBLICATIONS

International Search Report and Written Opinion issued in corresponding International PCT Application No. PCT/US2019/041886; dated Oct. 7, 2020.

* cited by examiner

*Primary Examiner* — Catherine Loikith

(74) *Attorney, Agent, or Firm* — Barnes & Thornburg LLP

(57) ABSTRACT

A plug for displacing cement in a downhole environment comprising a seal surface having at least one profile. The seal surface, in response to applied pressure, creates a hydraulic seal with another device. The seal surface can be made of molded rubber and the profile formed thereon can be formed from the molded rubber and during the molding process. The profile can be a semicircular profile or multiple semicircular profiles. The profile or profiles can be one or more semicircular profiles and one or more line profiles. The plug can be a bottom plug and the seal surface can be an upstream seal surface and the other device can be a float collar. The plug can be a top plug and the seal surface can an upstream seal surface and the other device can be a bottom plug.

20 Claims, 5 Drawing Sheets

CEMENTING PLUG FORMED WITH HIGH PRESSURE SEAL

BACKGROUND

In the oilfield industry, sections of a wellbore are created for further development. In those sections for further development, hanging and fixing additional well casing and cementing operations are required. In order to facilitate this development phase, cementing plugs, among their other functions, are required to create a proper hydraulic seal with the objects they interface with and are required to create those seals even in response to high pressure landing situations. If a proper hydraulic seal is not created, the quality of the cementing operation can be affected.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1A:
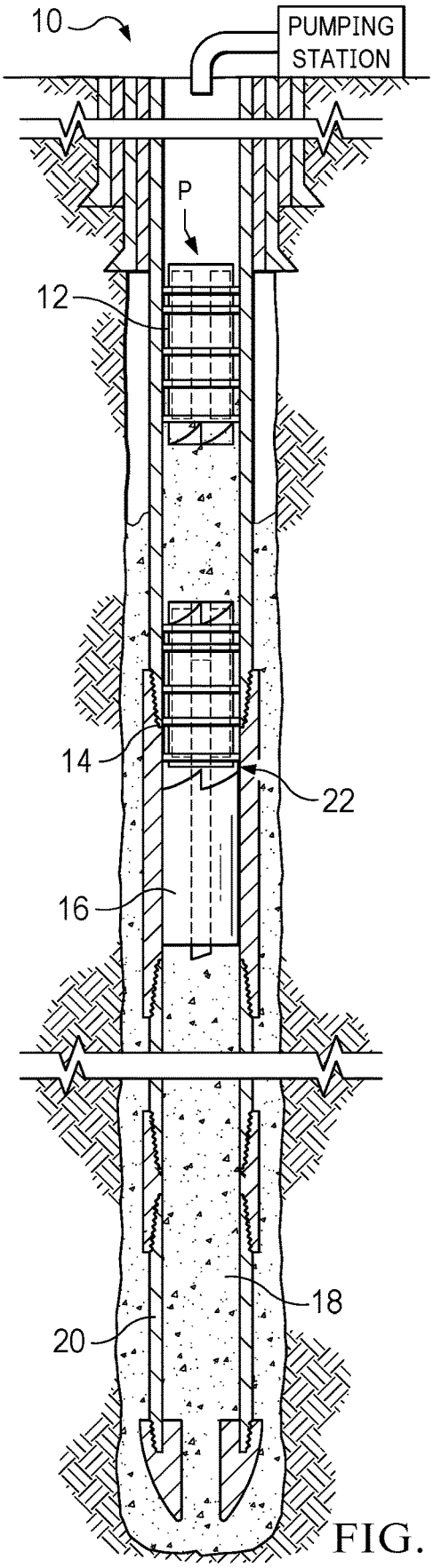
FIGS. 1A and 1B are illustrations of a well site wherein cementing operations are performed, in accordance with certain example embodiments.

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

In the oilfield industry, development of a well site includes cementing operations where new sections of a wellbore are created and a new foundation is laid using cement and well casing. To aid in this development process, top and bottom cementing plugs are used. In general, cementing plugs are made from molded rubber and comprise flanges traversing the plugs and, in the case of the bottom plug, includes a rupture disk. The plugs are used to clean previously installed sections of well casing and isolate a cement slurry within a section between the top and bottom plug. In doing so, the cement slurry can be delivered uncontaminated to an area of development within the wellbore. As the combination of the top plug, cement slurry, and bottom plug traverse the wellbore through the well casing, the bottom plug eventually makes contact with a landing collar. As more force is applied to the combination, the rupture disk ruptures and the cement slurry can be delivered to the new development area through the landing collar. In order to maintain the quality of the cement slurry, a proper hydraulic seal needs to be created between the bottom plug and the landing collar. However, the landing collar is made out of cement and the interface between the bottom plug and the landing collar is flat. The contact between the bottom plug and the landing collar is usually under high pressure force and, as such, a proper seal cannot always be created. As a result, the cement slurry can become contaminated.

A new cementing plug is presented herein. The plug includes a single, or a series of, semi-circular profiles, and/or other profile types, molded onto the sealing ends of at least one plug. Other profile can include triangles, ovals, or other shapes. Additionally, the sealing profile or profiles can be bordered by at least one flat profile, approximating the function of back-up rings. Sealing profiles added to the ends of plugs create a better seal when high pressures are used to force the top and bottom plugs together. An additional advantage is being able to modify the plugs without having to change the inserts. I.e., by adding including the profile with the rubber mold, the plug can be altered without having to also change the plastic core material. In addition, by adding profiles to the bottom plug, the complexity of the design and manufacture of the concrete/metal landing collars is reduced since causing damage to the concrete is minimized. Furthermore, service quality is improved. During operations, the plugs are often landed under relatively high pressures in order to create the needed seal between the plug and the landing collar. However, operating under these high pressures in the well casing can potentially cause a hydrostatically or hydrologically discharge with other products in the casing. Since the profiles can provide for a seal under less intensives pressures, the chance of a discharge is reduced.

The term upstream, as used herein, refers to a location in a wellbore closest to a hydrocarbon reservoir. Downstream, as used herein, refers to a location in a wellbore further away from a hydrocarbon reservoir and nearer the wellbore surface. As such, upstream and downstream interfaces, as used herein, are referenced as interfaces closest to and further from a hydrocarbon reservoir, respectively, and furthest from and closest to wellbore surface, respectively.

Figure 1B:
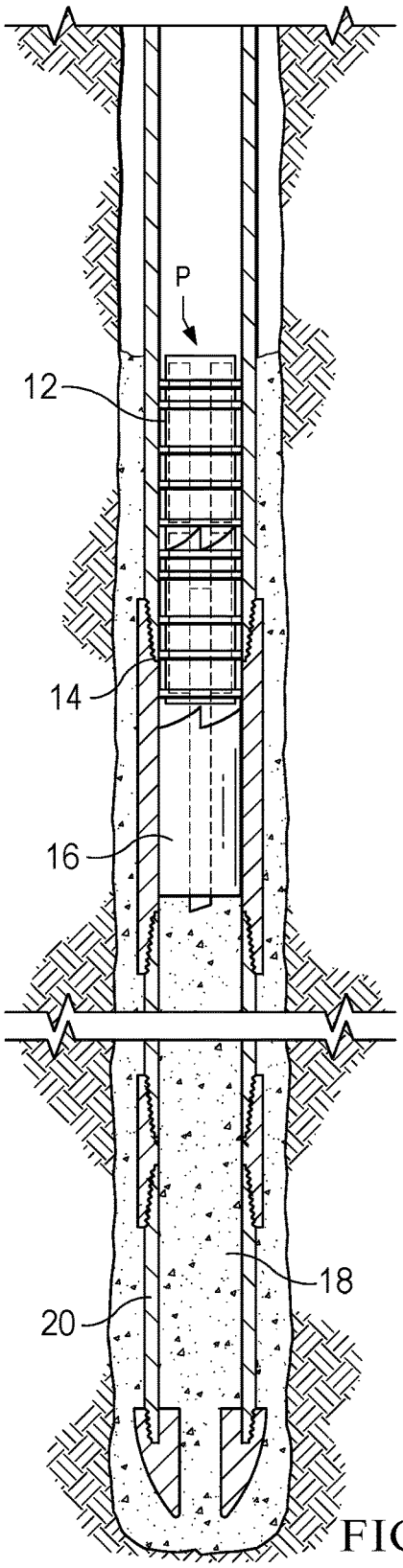

Referring now to FIGS. 1A and 1B, illustrated are diagrams of a well site where cementing operations are performed, in accordance with certain example embodiments, denoted generally as 10. The well site 10 comprises a wellbore and inside the wellbore a top plug 12, a bottom plug 14, and a landing collar 16 are used to set and stabilize well casing 20. A cement slurry 18 can be pumped into the well using a pumping station and subsequently pushed through the ID of the well casing 20 by the top plug 12 using pressurized force from the pumping station. The force from the top plug 12 and cement slurry 18 ruptures a rupture disk of the bottom plug 14 and the cement slurry can be pushed through the landing collar 16 and into a newly developed section of the well beneath the landing collar 16. The bottom plug comprises an O-ring type seal having a profile formed on at least one of the downstream and upstream interface of the bottom plug 14. In addition, the top plug 12 can also include an O-ring type seal. The O-ring type seal can comprise any type profile. The profile can be semi-circular or flat or a combination of the two can include multiple profiles and profile types. The profiles are not limited to any one shape. The non-congruency of the O-ring type structure formed on the interface creates the improved hydraulic seal. In FIG. 1A, bottom plug 14 includes the seal 22 having a semi-circular profile, as will be discussed in reference to FIGS. 2A, 2B, 3 and 4. After top plug 12 is forced, under high pressure (p), down the well casing 20 and lands on the bottom plug 14, FIG. 2B, the hydraulic seal is properly created between the bottom plug 14 and the landing collar 16 and, optionally, between the bottom plug 14 and top plug 12.

Figure 2A:
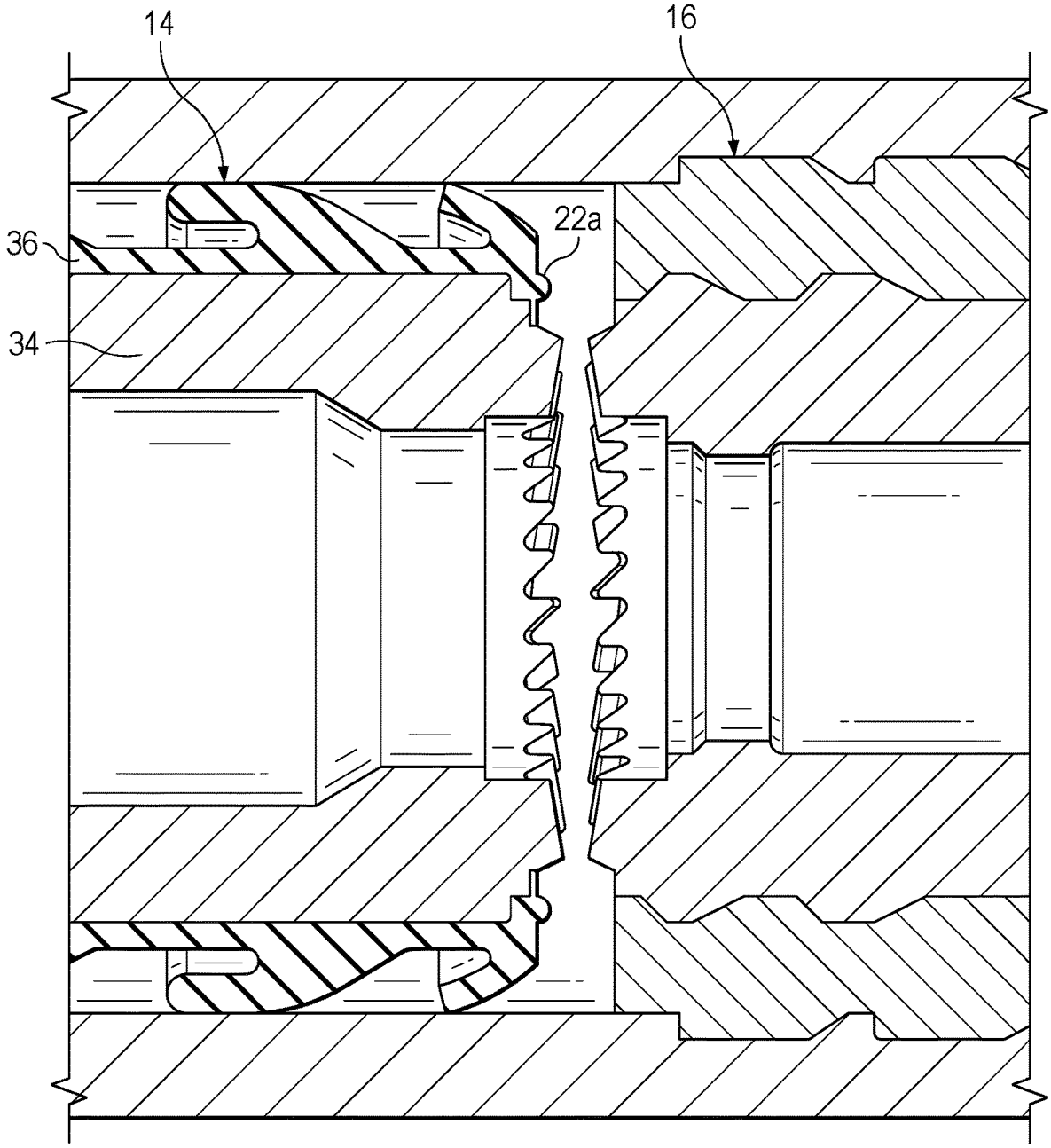
FIGS. 2A and 2B are illustrations of a cut-away view of a bottom plug that comprises a single, semi-circular profile and landing collar, in accordance with certain example embodiments.
Figure 2B:
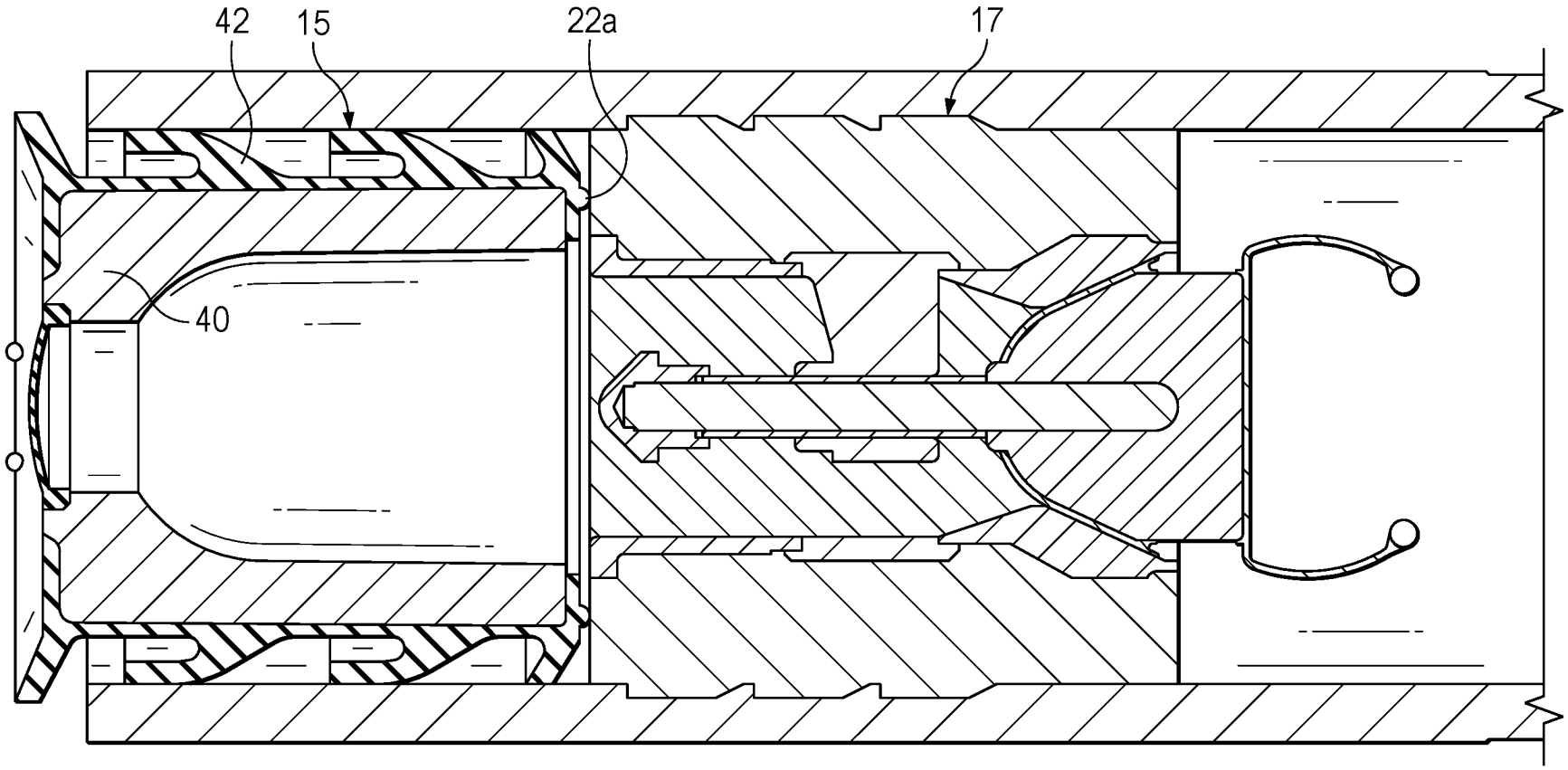
Figure 3:
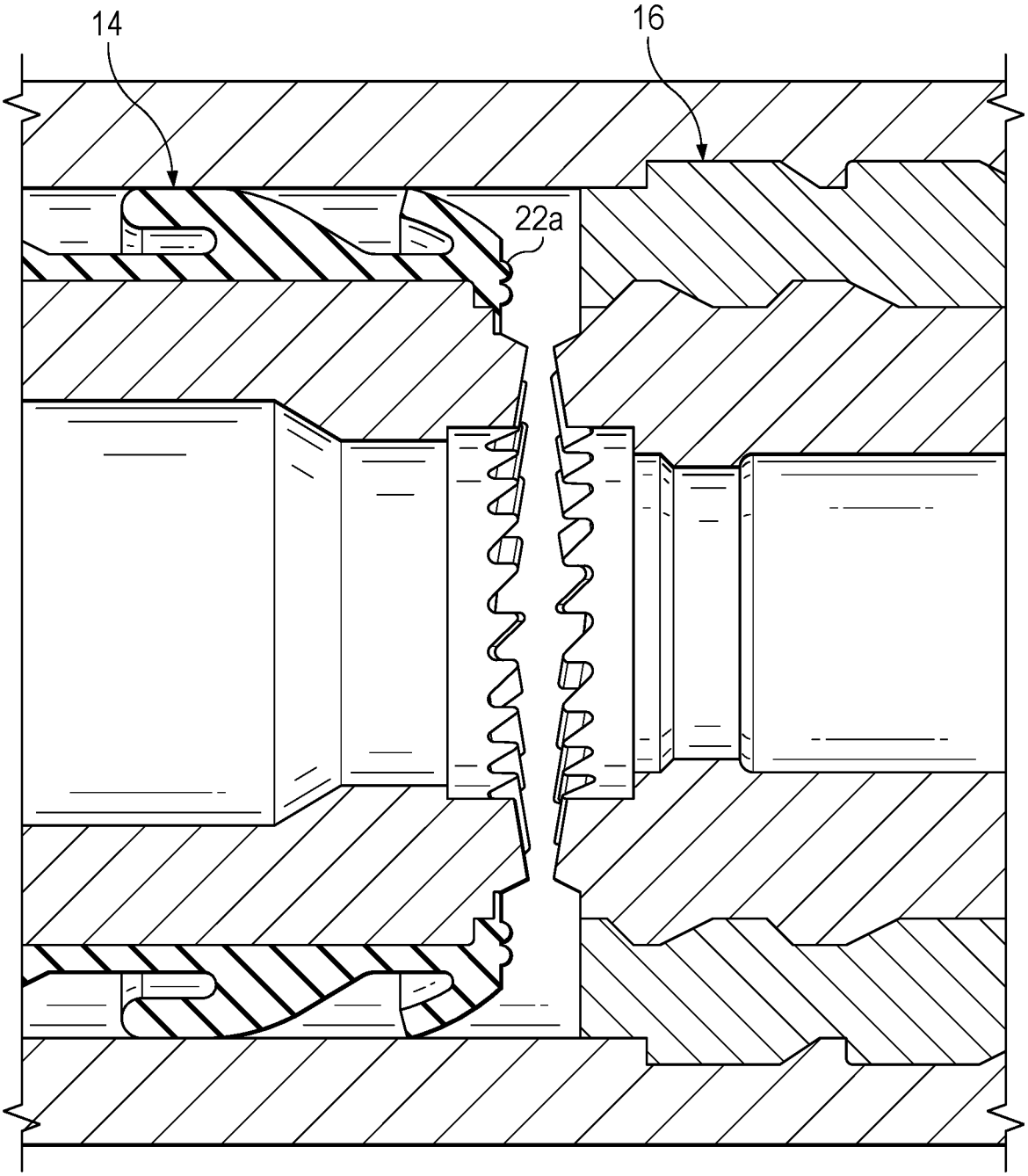
FIG. 3 is an illustration of another cut-away view with the bottom plug comprising multiple semi-circular profiles, in accordance with certain example embodiments.
Figure 4:
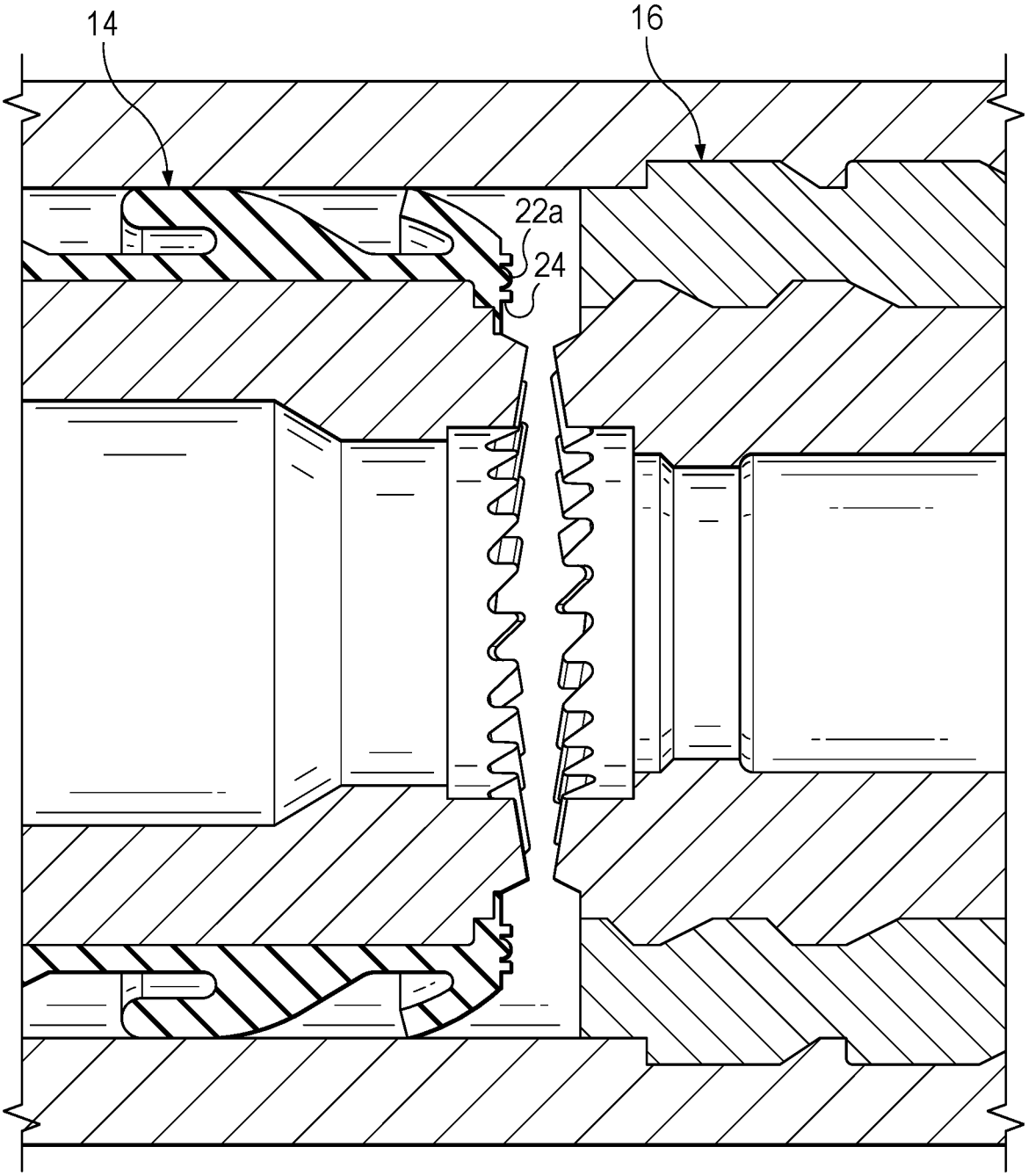
FIG. 4 is an illustration of yet another cut-away view with the bottom plug comprising a different profile, in accordance with certain example embodiments.

Referring now to FIGS. 2A and 2B, illustrated are cut-away views of bottom plugs 14, 15 that comprise a single, semi-circular profile 22*a* and landing collar 16, 17, in accordance with certain example embodiments. The plugs 14, 15 include an outer rubber layer, a plastic insert, and a pipe section. The plugs 14, 15 further include the O-ring type seals formed with the molded rubber layer. As pressure is applied to the plugs 14, 15, semi-circular profile 22*a* creates a hydraulic seal with the interface of the landing collars 16, 17. The landing collars 16, 17 are made of concrete and include pipe section that traverses the center. The interface between the O-ring type seals of the bottom plugs 14, 15 and the landing collars is rubber to concrete. FIG. 3 is another cut-away view with the bottom plug 14 comprising multiple semi-circular profiles 22*a*, in accordance with certain example embodiments. FIG. 4 is yet another cut-away view with the bottom plug comprising a different profile, in accordance with certain example embodiments. The profile comprises a single semi-circular profile 22*a* and multiple flat profiles 24 that form rings around the semi-circular profile. It should also be understood that the aforementioned profiles can also apply to the upstream interface of the top plug 12 or the downstream interface of the bottom plug. Additionally, the plugs in FIG. 1-2 illustrate the flanges, e.g. 30, in FIG. 2. Bottom plug 14 additionally comprises an outer rubber layer 36 encompassing a plastic insert layer 34. The plastic insert layer 34 comprises a seal surface. Bottom plug 15 additionally comprises an outer rubber layer 42 encompassing a plastic insert layer 40. The second outer layer 42 comprises a seal surface.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a plug for displacing cement in a downhole well environment, the plug comprising: a seal surface having at least one profile; wherein the seal surface creates a hydraulic seal with another device when under pressure;

Clause 2, the plug of clause 1 wherein the seal surface is made of molded rubber;

Clause 3, the plug of clause 2 wherein the at least one profile is integrated with the seal and formed from the molded rubber;

Clause 4, the plug of clause 1 wherein the at least one profile comprises at least one semi-circular profile;

Clause 5, the plug of clause 1 wherein the at least one profile comprises at least one semicircular profile and at least one line profile;

Clause 6, the plug of clause 1 wherein the plug is a bottom plug and the seal surface is an upstream seal surface and the other device is a float collar;

Clause 7, the plug of clause 1 wherein the plug is a top plug and the seal surface is an upstream seal surface and the other device is a bottom plug;

Clause 8, a method of displacing cement in a downhole well environment, the method comprising: propelling a bottom plug into the downhole well environment; pumping cement into the downhole well environment above the bottom plug; forcing the cement through the bottom plug by propelling a top plug into the downhole well environment above the cement; and creating a hydraulic seal between the plug and another device; wherein the plug comprises a seal surface having at least one profile;

Clause 9, the method of clause 8 wherein the seal surface is made of molded rubber;

Clause 10, the method of clause 9 wherein the at least one profile is integrated with the seal and formed from the molded rubber;

Clause 11, the method of clause 8 wherein the at least one profile comprises at least one semi-circular profile;

Clause 12, the method of clause 8 wherein the at least one profile comprises at least one semicircular profile and at least one line profile;

Clause 13, the method of clause 8 wherein the plug is a bottom plug and the seal surface is an upstream seal surface and the other device is a float collar;

Clause 14, the method of clause 8 wherein the plug is a top plug and the seal surface is an upstream seal surface and the other device is a bottom plug;

Clause 15, a system for displacing cement in a downhole well environment, the system comprising: a bottom plug including a seal surface having at least one profile; a top plug; wherein the seal surface, in response to receiving the top plug, creates a hydraulic seal with at least one of a float collar and the top plug;

Clause 16, the system of clause 15 wherein the seal surface is made of molded rubber;

Clause 17, the system of clause 16 wherein the at least one profile is integrated with the seal and formed from the molded rubber;

Clause 18, the system of clause 15 wherein the at least one profile comprises at least one semi-circular profile;

Clause 19, the system of clause 15 wherein the at least one profile comprises at least one semicircular profile and at least one line profile; and Clause 20, the system of clause 15 wherein the seal surface is at least one of an upstream seal surface and a downstream seal surface.

What is claimed is:

1. A plug for displacing cement in a downhole well environment, the plug comprising:

an insert layer;

an outer layer encompassing a section of the insert layer, the outer layer having a sealing surface and at least one wiper; and the sealing surface having a first profile and a second profile formed therein, the first profile radially offset from the second profile, the first profile is a semi-circular profile or a line profile, the second profile is a semi-circular profile or a line profile; wherein the plug has a center axis in a plane extending along a length of the plug; wherein the first profile and the second profile are both positioned adjacent to one another on an exterior surface of a bottom of the plug; the sealing surface being perpendicular to the axis of the plug;

wherein the sealing surface creates a hydraulic seal on a surface of another device when under pressure.

2. The plug of claim 1 wherein the insert layer is a plastic insert or concrete, wherein the outer layer and sealing surface are made of molded rubber.

3. The plug of claim 2 wherein at least one selected from a group comprising the first profile and the second profile is integrated with the sealing surface and formed from the molded rubber.

4. The plug of claim 1 wherein at least one selected from a group comprising the first profile and the second profile comprises a plurality of semi-circular profiles.

5. The plug of claim 1 wherein at least one selected from a group comprising the first profile and the second profile comprises a plurality of semicircular profiles and a plurality of line profiles.

6. The plug of claim 1 wherein the plug is a bottom plug and the sealing surface is a downstream surface and the other device is a float collar.

7. The plug of claim 1 wherein the plug is a top plug and the sealing surface is a downstream seal surface and the other device is a bottom plug.

8. The plug of claim 1 wherein the first profile and the second profile are continuous with the outer layer and comprise a same material.

9. A method of displacing cement in a downhole well environment, the method comprising:

propelling a bottom plug into the downhole well environment;

pumping cement into the downhole well environment above the bottom plug;

forcing the cement through the bottom plug by propelling a top plug into the downhole well environment above the cement; and creating a hydraulic seal between the bottom plug and another device;

wherein the bottom plug comprises:

an insert layer;

an outer layer encompassing a section of the insert layer, the outer layer having a sealing surface and at least one wiper; and the sealing surface having a first profile and a second profile formed therein, the first profile radially offset from the second profile, the first profile is a semi-circular profile or a line profile, the second profile is a semi-circular profile or a line profile; wherein the plug has a center axis in a plane extending along a length of the plug; wherein the first profile and the second profile are both positioned adjacent to one another on an exterior surface of a bottom of the plug; the sealing surface being perpendicular to the axis of the plug;

wherein the sealing surface creates a hydraulic seal on a surface of another device when under pressure.

10. The method of claim 9 wherein the insert layer is a plastic insert or concrete, wherein the outer layer and sealing surface are made of molded rubber.

11. The method of claim 10 wherein at least one selected from a group comprising the first profile and the second profile is integrated with the sealing surface and formed from the molded rubber.

12. The method of claim 9 wherein at least one selected from a group comprising the first profile and the second profile comprises a plurality of semi-circular profiles.

13. The method of claim 9 wherein at least one selected from a group comprising the first profile and the second profile comprises a plurality of semicircular profiles and a plurality of line profiles.

14. The method of claim 9 wherein the other device is a float collar.

15. The method of claim 9 wherein the first profile and the second profile are continuous with the outer layer and comprise a same material.

16. A system for displacing cement in a downhole well environment, the system comprising:

a bottom plug comprising:

an insert layer;

an outer layer encompassing a section of the insert layer, the outer layer comprising a sealing surface;

the sealing surface having a first profile and a second profile formed therein, the first profile radially offset from the second profile, the first profile is a semi-circular profile or a line profile, the second profile is a semi-circular profile or a line profile; wherein the plug has a center axis in a plane extending along a length of the plug; wherein the first profile and the second profile are both positioned adjacent to one another on an exterior surface of a bottom of the plug; the sealing surface being perpendicular to the axis of the plug; wherein the sealing surface seals against a flat surface; and a top plug;

wherein the sealing surface, in response to receiving the top plug, creates a hydraulic seal with a landing collar.

17. The system of claim 16 wherein the insert layer is a plastic insert, wherein the outer layer and sealing surface are made of molded rubber.

18. The system of claim 17 wherein at least one selected from a group comprising the first profile and the second profile is integrated with the sealing surface and formed from the molded rubber.

19. The system of claim 15 wherein at least one selected from a group comprising the first profile and the second profile comprises a plurality of semi-circular profiles.

20. The system of claim 16 wherein at least one selected from a group comprising the first profile and the second profile comprises a plurality of semicircular profiles and a plurality of line profiles.

* * * * *